US010315414B2

(12) United States Patent
Van Brocklin

(10) Patent No.: US 10,315,414 B2
(45) Date of Patent: Jun. 11, 2019

(54) PRINTHEAD WAVEFORM VOLTAGE AMPLIFIER

(71) Applicant: HEWLETT-PACKARD DEVELOPMENT COMPANY, L.P., Houston, TX (US)

(72) Inventor: Andrew L. Van Brocklin, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/827,964

(22) Filed: Nov. 30, 2017

(65) Prior Publication Data

US 2018/0086056 A1 Mar. 29, 2018

Related U.S. Application Data

(62) Division of application No. 14/359,244, filed as application No. PCT/US2011/064200 on Dec. 9, 2011, now Pat. No. 9,862,183.

(51) Int. Cl.

| | |
|---|---|
| ***B41J 29/38*** | (2006.01) |
| ***B41J 2/045*** | (2006.01) |
| *B41J 2/14* | (2006.01) |

(52) U.S. Cl.

CPC ..... *B41J 2/04541* (2013.01); *B41J 2/04581* (2013.01); *B41J 2/04588* (2013.01); *B41J 2002/1437* (2013.01)

(58) Field of Classification Search

USPC ..... 347/5, 9, 10

See application file for complete search history.

(56) References Cited

U.S. PATENT DOCUMENTS

| | | | |
|---|---|---|---|
| 5,841,448 | A | 11/1998 | Moriyama et al. |
| 6,215,356 | B1 | 4/2001 | Servaes et al. |
| 6,439,678 | B1 | 8/2002 | Norton |
| 6,764,152 | B2 | 7/2004 | Umeda et al. |
| 7,049,756 | B2 | 5/2006 | Aiba |
| 7,114,791 | B2 | 10/2006 | Umeda et al. |
| 7,234,788 | B2 | 6/2007 | Gardner |

(Continued)

FOREIGN PATENT DOCUMENTS

| | | |
|---|---|---|
| CN | 102211472 A | 10/2011 |
| TW | 448512 | 8/2001 |

(Continued)

*Primary Examiner* — Lam S Nguyen

(74) *Attorney, Agent, or Firm* — HP Inc. Patent Department

(57) ABSTRACT

In some examples, a drive signal generator for a fluid ejection element of a piezoelectric printhead, includes a core amplifier to amplify an input waveform to provide an amplified waveform, and a plurality of rail power circuits, each coupled to a different power input of the core amplifier. Each rail power circuit of the plurality of rail power circuits includes a comparator to compare an instantaneous voltage of the amplified waveform to a subset of a plurality of voltage sources, and a switch to, based on the comparing by the comparator, couple to a respective power input of the core amplifier a voltage source in the subset of the plurality of voltage sources that is closest to the instantaneous voltage and sufficient to generate the amplified waveform.

18 Claims, 10 Drawing Sheets

(56) References Cited

U.S. PATENT DOCUMENTS

| | | | | |
|---|---|---|---|---|
| 7,278,698 | B2 | 10/2007 | Tamura | |
| 2005/0057588 | A1 | 3/2005 | Umeda | |
| 2007/0236521 | A1 | 10/2007 | Kondoh | |
| 2008/0100652 | A1 | 5/2008 | Oshima et al. | |
| 2008/0170090 | A1* | 7/2008 | Oshima | B41J 2/04541 347/10 |
| 2008/0238964 | A1* | 10/2008 | Umeda | B41J 29/393 347/10 |
| 2010/0201291 | A1 | 8/2010 | Cheiky et al. | |

FOREIGN PATENT DOCUMENTS

| | | | |
|---|---|---|---|
| TW | 200523122 | A | 7/2005 |
| WO | WO-2010052132 | | 5/2010 |

* cited by examiner

| VOLTAGE | CUA | CUB | CUC | SU1 | SU2 | SU3 | SU4 | VPP | CLA | CLB | CLC | SL1 | SL2 | SL3 | SL4 | VQQ |
|---|---|---|---|---|---|---|---|---|---|---|---|---|---|---|---|---|
| V1 < V < V2 | 0 | 0 | 0 | 0 | 0 | 0 | 1 | V2 | 0 | 0 | 0 | 0 | 0 | 0 | 1 | V1 |
| V2 < V < V3 | 0 | 0 | 1 | 0 | 0 | 1 | 0 | V3 | 0 | 0 | 1 | 0 | 0 | 1 | 0 | V2 |
| V3 < V < V4 | 0 | 1 | 1 | 0 | 1 | 0 | 0 | V4 | 0 | 1 | 1 | 0 | 1 | 0 | 0 | V3 |
| V4 < V < V5 | 1 | 1 | 1 | 1 | 0 | 0 | 0 | V5 | 1 | 1 | 1 | 1 | 0 | 0 | 0 | V4 |

1XX

FIG. 8

PRINTHEAD WAVEFORM VOLTAGE AMPLIFIER

CROSS REFERENCE TO RELATED APPLICATIONS

This is a continuation of U.S. application Ser. No. 14/359,244, having a national entry date of May 19, 2014, which is a national stage application under 35 U.S.C. § 371 of PCT/US2011/064200, filed Dec. 9, 2011, which are both hereby incorporated by reference in their entirety.

BACKGROUND

Liquid-jet (also known as inkjet) printing devices eject liquid onto a receiving media such as, for example, paper. The liquid can be ejected in accordance with a desired image to be formed on the media. Typically a large number of liquid ejection elements (also referred to as "ejectors", or "nozzles" herein) are closely spaced on a liquid-jet printhead to facilitate the printing of high-quality images.

Different liquid-jet technologies include piezoelectric and thermal inkjet technologies. Piezoelectric printing devices employ membranes that deform upon the controllable application of electric energy. This membrane deformation causes pressure pulses inside liquid-filled chambers to eject one or more small drops of liquid out of the printhead nozzles. For some types of liquids and applications, piezoelectric technologies offer optimum printing performance for certain liquids, such as UV curable printing inks, whose higher viscosity and/or chemical composition is not amenable to producing high-quality printing using thermal inkjet technologies.

BRIEF DESCRIPTION OF THE DRAWINGS

FIG. 8 is a table that describes the operation of the upper and lower rail power switches of FIGS. 6-7 in accordance with an embodiment of the present disclosure.

DETAILED DESCRIPTION

Figure 1:
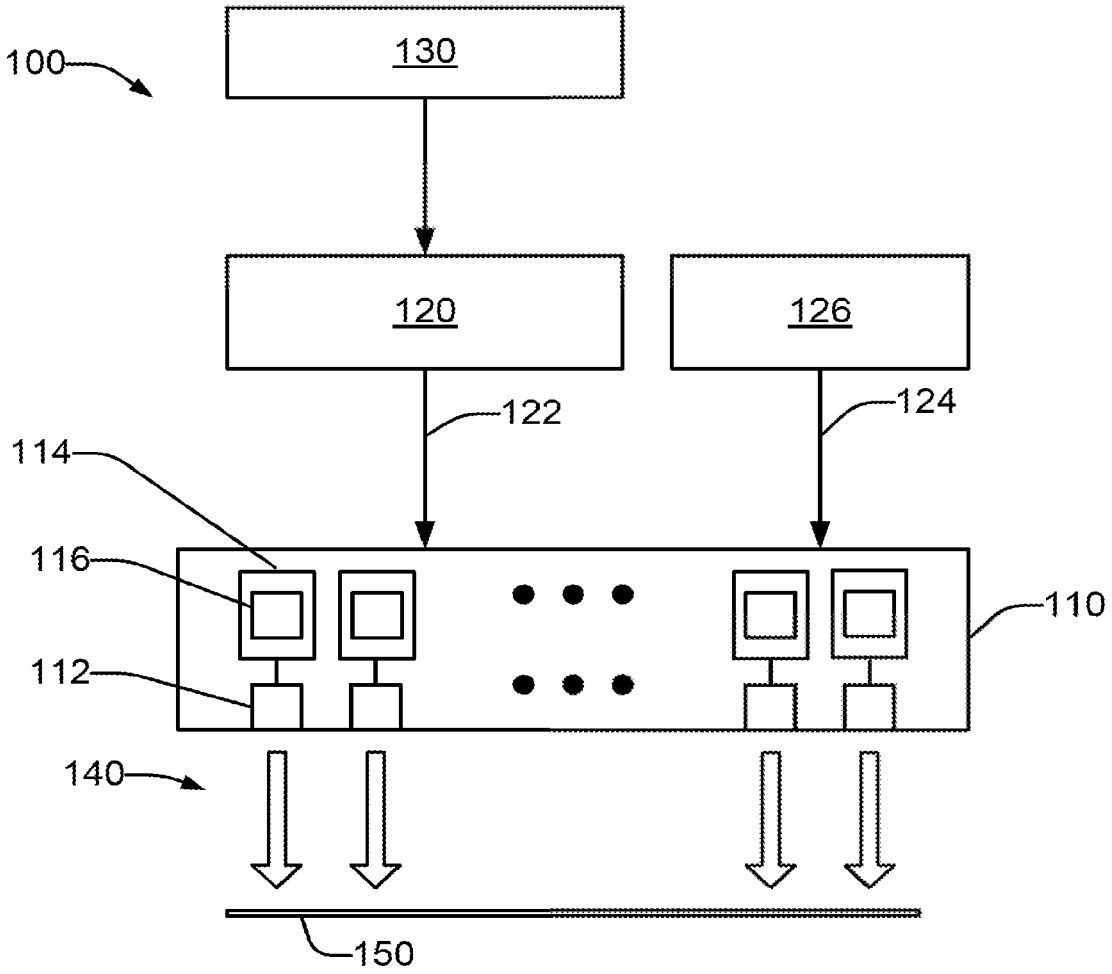
FIG. 1 is a schematic representation of an example printing system in accordance with an embodiment of the present disclosure.

As noted in the background section, liquid-jet printing devices eject liquid onto media in response to the application of electrical energy. This ejection includes precisely emitting the liquid onto accurately specified locations, with or without making a particular image on the media. As defined herein and in the appended claims, a "liquid" shall be broadly understood to mean a fluid not composed substantially or primarily of a gas or gases. A liquid-jet printing device has at least one, and typically a number of, ejection elements that individually eject liquid. These ejection elements are often fabricated using micro-electro-mechanical systems (MEMS) technology. In general, the more elements that can be arranged into a particular linear distance or area of the device, the higher the quality of the print output and/or the faster the speed of the printing operation. Electrical energy in the form of a drive signal is applied on a per-nozzle basis to cause the ejection elements to eject liquid as desired. Existing liquid-jet technologies typically apply the same drive signal to each ejection element. However, some elements may exhibit liquid-ejection characteristics that differ from other elements, due to manufacturing defects and tolerances, age, wear and tear, and so on. As such, different elements may eject liquid in different ways responsive to application of the same drive signal, which can result in poor image formation performance of the liquid-jet printing device.

However, the different liquid-ejection characteristics of different ejection elements may be compensated for ("trimmed") by applying as the drive signal a voltage waveform whose shape, height, and width (duration) is specific to each ejection element. The shape, height, and width (duration) of the voltage waveform control how an ejection element ejects liquid. Trimming can extend the life of a liquid-jet printing device (or a replaceable portion thereof such as a printhead), or salvage an otherwise-defective device or printhead, by compensating for the effects of age and wear and tear. It can also enable such devices and printheads to be manufactured to less restrictive tolerances, using less expensive processes, and can overcome certain manufacturing defects, resulting in higher yield and/or lower prices for the printheads.

Due to packaging and interconnect constraints, the individual drive signal generator circuitry for each corresponding ejection element is typically located near that ejection element. The interconnect pitch is typically too tight to run a cable from the closely-spaced ejection elements to an external circuit, such as an ASIC, that is located some distance away, such as an ASIC located off the printhead that contains the ejection elements. However, the amount of power that is dissipated on during operation is a limiting factor in the number of individually-compensated ejection elements that can be accommodated in a given area of the device, such as on a given-size printhead. A significant amount of this power dissipation occurs as a result of charging and discharging the capacitive load of the piezoelectric MEMS ejection element. Additional bias power is also dissipated in the drive signal generator circuitry. Removal of the heat associated with the power dissipation is challenging. Some printing devices with per-nozzle piezoelectric ejection element compensation use liquid cooling to remove the heat. For example, circulating water in a cooling loop may be passed through a water-air heat exchanger with air blowers which in turn air-cool the printhead. This solution is undesirably expensive and complex, and thus is generally limited to certain niche printing applications. Also, the cost of industrial conditioned power supplies, and the cost of the power used to operate them, are additional concerns. The teachings of the present disclosure can reduce these costs, and the resulting reduction in power use is environmentally beneficial as well.

Disclosed herein are techniques that reduce the power dissipation in a piezoelectric printing device having a high density of individually-trimmed liquid ejection elements, allowing the device to be adequately cooled using simpler methods of printhead heat removal such as IR radiation, convection to ambient air, thermal conduction to the printhead body and/or mounting substrate, thermal coupling to the fluid(s) being ejected, and the like.

Referring now to the drawings, there is illustrated an example of a piezoelectric printing apparatus having independently-controllable liquid ejection elements, and an individually-controlled drive signal generator for each ejection element. Each drive signal generator includes a voltage amplifier that amplifies an input voltage waveform and applies the amplified voltage waveform to the corresponding ejection element as the drive signal. Power rail circuits in each voltage amplifier are each coupled to respective power inputs of a core amplifier circuit of the voltage amplifier. The power rail circuits dynamically switch the voltages that are applied to the power inputs, based on the instantaneous voltage of the amplified waveform. This recaptures (regenerates) in the amplifier a portion of the power stored in each ejection element, thus reducing the power that is dissipated for each ejection element, and thus in the apparatus as a whole. This technique enables the printhead to be cooled using the simpler methods of heat removal listed above.

Considering now a block diagram of one example of a rudimentary liquid-jet printing system, and with reference to FIG. 1, an example piezoelectric printing apparatus 100 includes a number of liquid ejection elements 112 and corresponding drive signal generators 114, a controller 120, and a plurality of power supplies 126.

Each drive signal generator 114 is for just one of the ejection elements 112, although each ejection element 112 may have more than one drive signal generator 114. Each drive signal generator 114 includes a voltage amplifier 116.

In some examples, a number of the liquid ejection elements 112 and the corresponding drive signal generators 114 may be disposed in a printhead 110. The apparatus 100 may include one or more such printheads 110. As defined herein and in the appended claims, a "printhead" shall be broadly understood to mean an element of the apparatus, typically removable or replaceable, that houses at least liquid ejection elements arranged to collectively eject liquid at a certain print pitch. The print pitch typically may range from a 1 millimeter print pitch down to a micron-scale print pitch. For print pitches less than about $1/100^{th}$ inch, the printhead typically is implemented as a MEMS (micro-electro-mechanical system) device.

In other examples, the liquid ejection elements 112 and the corresponding drive signal generators 114 may be disposed in the apparatus 100 other than in a printhead.

The controller 120 receives print data 130 which corresponds to the image or other information to be printed, and transforms the print data 130 into data signals 122 to the printhead 110. The data signals 122 are directed to specific liquid ejection elements 112, and control the ejection of liquid drops 140 from the elements 112 onto a medium 150. The data signals 122 are typically transmitted in multiplexed form from the controller 120 to a demux circuit (not shown), which in turn distributes the appropriate signals to each drive signal generator 114, in order to reduce or minimize the number of data signal lines used. Power supplies 126 supply power 124 to at least the drive signal generators 114. The power 124 may be supplied in a number of different voltages to be used by the power rail circuits.

Figure 2:
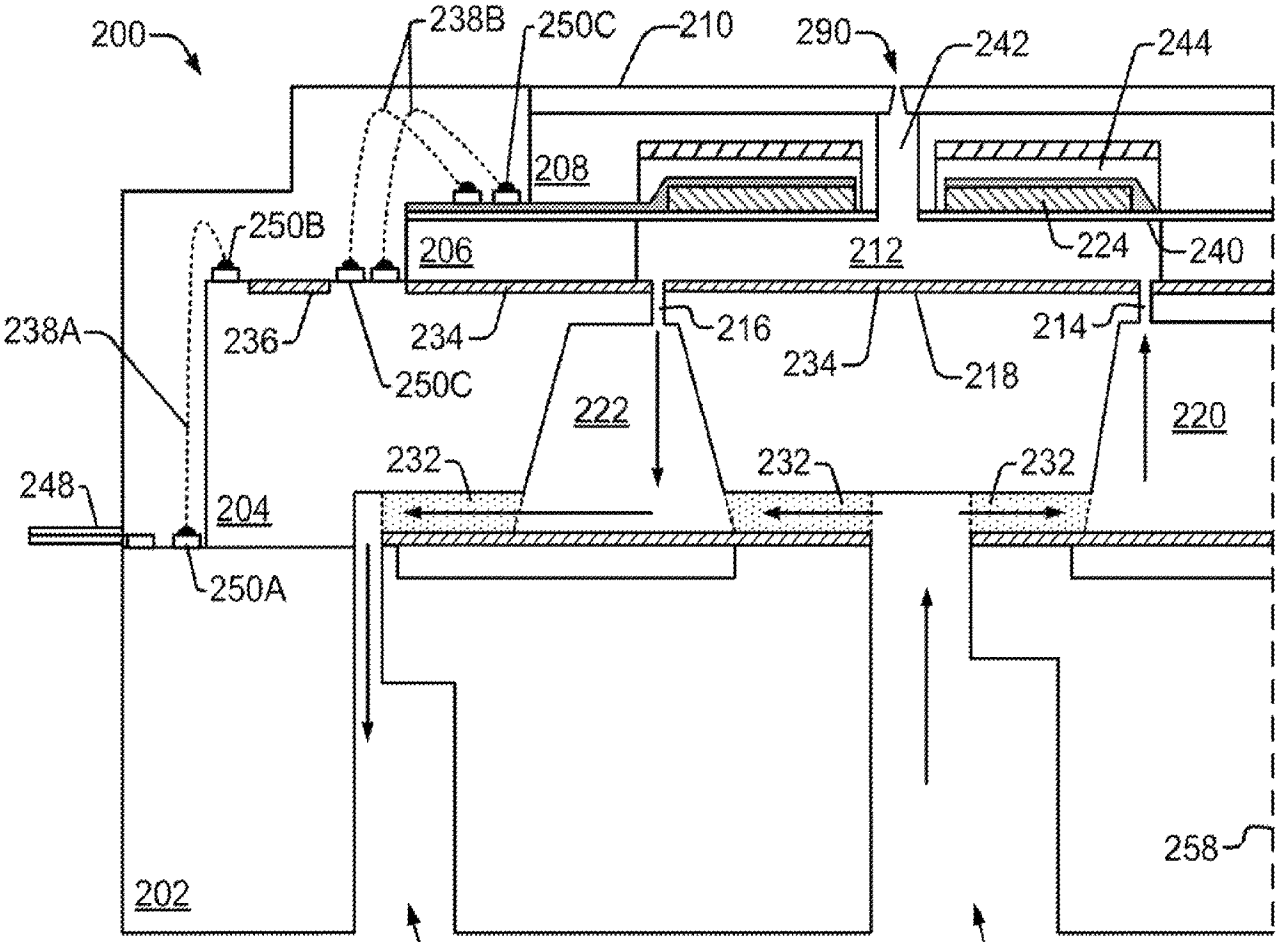
FIG. 2 is a schematic cross-sectional representation of an example printhead in accordance with an embodiment of the present disclosure usable with the printing system of FIG. 1.

Considering now one example of a printhead 110, and with reference to FIG. 2, an example printhead 200 has multiple die layers in a die stack. The layers may each have different functionality. The overall shape of the die stack may be pyramidal, with each die in the stack being narrower than the die below (i.e., referencing die 202 of FIG. 2 as the bottom die). That is, each die starting with the bottom substrate die 202 gets successively narrower as they progress upward in the die stack toward the nozzle layer (nozzle plate) 210. In some embodiments, where extra space at the ends of the die is desired for alignment marks, trace routing, bond pads, fluidic passages, etc., a die in an above layer may also be shorter in length than the die below. The narrowing and/or shortening of the die from the bottom to the top of the die stack creates a staircase effect on the sides and/or the ends of the die that enables die layers having circuitry to be connected via wire bonds between pads on the exposed stair steps.

The layers in the die stack include a first (i.e., bottom) substrate die 202, a second circuit die 204 (or ASIC die), a third actuator/chamber die 206, a fourth cap die 208, and a fifth nozzle layer 210 (or nozzle plate). In some embodiments, the cap die 208 and nozzle layer 210 may be integrated as a single layer. Each layer in the die stack is typically formed of silicon, except for sometimes the nozzle layer 210. In some embodiments, the nozzle layer 210 may be formed of stainless steel or a durable and chemically inert polymer such as polyimide or SU8. The layers may be bonded together with a chemically inert adhesive such as epoxy (not shown). The die layers have fluid passageways such as slots, channels, or holes for conducting liquid to and from pressure chambers 212. Each pressure chamber 212 includes two ports (inlet port 214 and outlet port 216) located in the floor 218 of the chamber 212 (i.e., opposite the nozzle-side of the chamber 212) that are in liquid communication with a liquid distribution manifold (entrance manifold 220 and exit manifold 222). The floor 218 of the pressure chamber 212 is formed by the surface of the circuit layer 204. The two ports 214, 216 are on opposite sides of the floor 218 of the chamber 212 where they pierce the circuit layer 204 die and enable liquid to be circulated through the chamber 212 by external pumps (not shown). The piezoelectric actuators 224 are on a flexible membrane 240 that serves as a roof to the chamber 212 and is located opposite the chamber floor 218. Thus, the piezoelectric actuators 224 are located on the same side of the chamber 212 as are the nozzles 116 (i.e., on the roof or top-side of the chamber).

Bottom substrate die 202 comprises silicon, and it includes fluidic passageways 226 through which liquid is able to flow to and from pressure chambers 212 via the manifolds 220, 222.

Circuit die 204 is the second die in die stack and is located above the substrate die 202. Circuit die 204 is adhered to substrate die 202 and it is narrower than the substrate die 202. In some embodiments, the circuit die 204 may also be shorter in length than the substrate die 202. Circuit die 204 includes the manifolds 220, 222. Entrance manifold 220 provides ink flow into chamber 212 via inlet port 214, while outlet port 216 allows ink to exit the chamber 212 into exit manifold 222. Circuit die 204 also includes fluid bypass channels 232 that permit some ink coming into entrance manifold 220 to bypass the pressure chamber 212 and flow directly into the exit manifold 222 through the bypass 232. This allows desired ink flows to be achieved within pressure chambers 212 and sufficient pressure differentials maintained between chamber inlet ports 214 and outlet ports 216.

Circuit die 204 also includes CMOS electrical circuitry 234 which may be implemented in an ASIC 234 and fabricated on the upper surface of die 204 adjacent the actuator/chamber die 206. ASIC 234 includes ejection control circuitry that controls the pressure pulsing (i.e., firing) of piezoelectric actuators 224. At least a portion of ASIC 234 may be located directly on the floor 218 of the pressure chamber 212; a passivation layer (not shown) that includes a dielectric material may be used provide insulation and protection from the liquid in chamber 212.

Bond pads (collectively 250) interconnect dies in the die stack via wires (collectively 238). Circuit die 204 also includes electrical circuitry 236 that is fabricated on the edge of the die 204. Circuitry 234, 236 collectively comprise the drive signal generators 114. Even if the components of the drive signal generators 114 that generate the largest amount of heat are located in circuitry 236 outside the footprint of the actuator die 206, it is still close enough that conduction may occur through the silicon and adversely influence the performance of pressure chamber 212 and actuators 224.

The progressively smaller dies provides room at the die edges for bond pads 250 and wires 238, and trace routing between bond pads 250 (not all bond pads, wires, and traces are shown). The additional space at the die edges also allows the deposition of encapsulant to protect the wires 238 and bond pads 250 from damage. Having the circuit die 204 adjacent to or directly below the actuator die 206 reduces the length of wires 238 which improves signal integrity.

The next layer in the die stack above the circuit die 204 is the actuator/chamber die 206 ("actuator die 206", hereinafter). The actuator die 206 is adhered to circuit die 204 and it is narrower than the circuit die 204. In some embodiments, the actuator die 206 may also be shorter in length than the circuit die 204. Actuator die 206 includes pressure chambers 212 having chamber floors 218 that comprise the adjacent circuit die 204. Actuator die 206 additionally includes thin-film flexible membrane 240, such as silicon dioxide, located opposite the chamber floor 218 that serves as the roof of the chamber. Above and adhered to the flexible membrane 240 is piezoelectric actuator 224. Piezoelectric actuator 224 comprises a thin-film piezoelectric material such as a piezo-ceramic material that stresses mechanically in response to an applied electrical voltage. When activated, piezoelectric actuator 224 physically expands or contracts which causes the laminate of piezoceramic and membrane 240 to flex. This flexing displaces ink in the chamber 212, generating pressure waves that eject one or more liquid drops of a particular size or volume through an orifice 290. In the embodiment shown in FIG. 2, both the flexible membrane 240 and the piezoelectric actuator 224 are split by a descender 242 that extends between the pressure chamber 212 and orifice 290. Thus, piezoelectric actuator 224 is a split piezoelectric actuator 224 having a segment on each side of the chamber 212. In some embodiments, however, the descender 242 and orifice 290 are located at one side of the chamber 212 such that the piezoelectric actuator 224 and membrane 240 are not split.

Cap die 208 is adhered above the actuator die 206. The cap die 208 is narrower than the actuator 206, and in some embodiments it may also be shorter in length than the actuator die 206. Cap die 208 forms a cap cavity 244 over piezoelectric actuator 224 that encapsulates the actuator 224. The cavity 244 is a sealed cavity that protects the actuator 224. Although the cavity 244 is not vented, the sealed space it provides is configured with sufficient open volume and clearance to permit the piezoactuator 224 to flex without influencing the motion of the actuator 224.

Cap die 208 also includes the descender 242. The descender 242 is a channel in the cap die 208 that extends between the pressure chamber 212 and orifice 290, enabling ink to travel from the chamber 212 and out of the orifice 290 during liquid ejection events caused by pressure waves from actuator 224. Orifices 290 are formed in the nozzle layer 210, or nozzle plate. Nozzle layer 210 is adhered to the top of cap die 208 and is typically the same size (i.e., length and width, but not necessarily thickness) as the cap die 208.

Flex cable 248 may be connected to the die stack at an edge of a surface of the substrate die 202 as illustrated, or of another die layer such as the circuit die 204. In one example, flex cable 248 includes on the order of 30 lines that carry low voltage, digital control signals from a signal source such as controller 120, and power and ground from multiple power supplies 126. Serial digital control signals received via lines in flex cable 248 are typically converted (demultiplexed) by control circuitry in the drive signal generators 114 into parallel, analog actuation signals such as input voltage waveforms applied to corresponding amplifiers 116 to generate the drive signal to activate the piezoelectric actuators 224 of individual liquid ejection elements 112. Accordingly, a relatively small number of wires (e.g., wires 238A) are attached from bond pads 250A on the substrate die 202 to certain bond pads 250B on the circuit die 204 to carry serial control signals and power from the flex cable 248 to circuitry 234, 236 on circuit die 204. A much greater number of wires (e.g., wires 238B) are attached between certain other bond pads 250B of circuit die 204 and corresponding bond pads 250C of actuator die 206 to carry the many parallel actuation signals from the circuitry 234, 236 on circuit die 204, along individual wires 238B, to individual piezoelectric actuators 224 on actuator die 206.

FIG. 2 shows a partial cross-sectional view of die stack in a PIJ printhead 114. The die stack typically continues on toward the right side, past the dashed line 258. Features in the continued portion may mirror the features shown in FIG. 2.

As has been explained, the example printhead 200 of FIG. 2 has the circuit die 204 for the electronics disposed on the substrate die 202 in the same die stack as the actuator/chamber die 206 and the cap die 208 for the fluidics. In another example printhead (not shown), the circuit die 204, including the circuitry 234, 236 that collectively comprise the drive signal generators 114, is fabricated on the substrate die 202 in a different die stack from that of the actuator/chamber die 206 and the cap die 208. The different electrical die stack may be disposed on the substrate die 202 adjacent to the fluidics die stack having the dies 206, 208. In this example, because the liquid to be ejected from the components of the actuator/chamber die 206 does not pass through the circuit die 204, the circuit die 204 typically does not include the manifolds 220, 222 or fluid bypass channels 232. Fabricating the electronics circuitry 234, 236 in a different, adjacent die stack can allow the circuitry 234, 236 to be cooled independently from the fluidics die stack that has the dies 206, 208.

Figure 3:
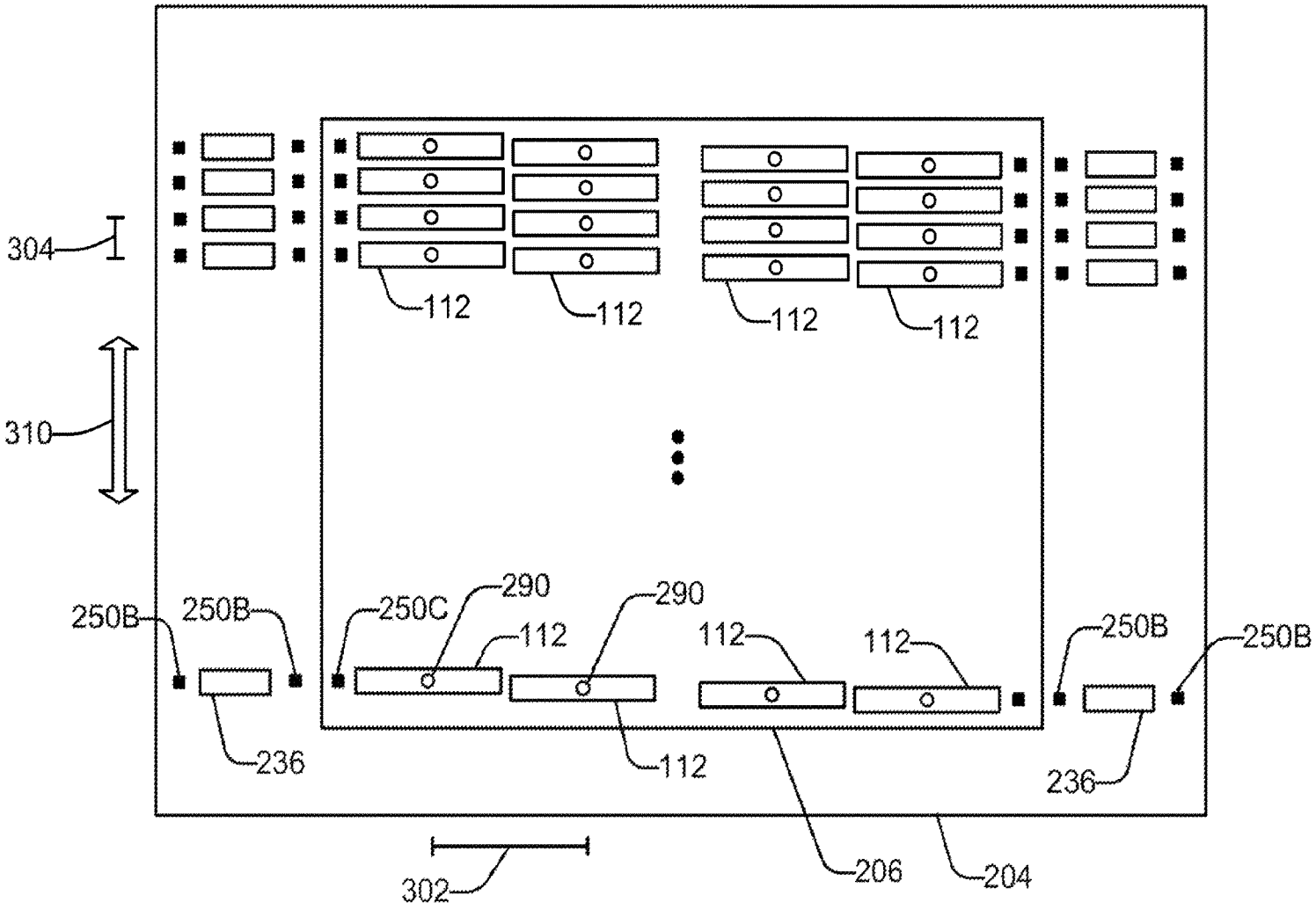
FIG. 3 is a schematic representation of a top view of the example printhead of FIG. 2 in accordance with an embodiment of the present disclosure.

Considering further one example of a printhead 110, and with reference to FIG. 3, a schematic diagram (not to scale) of top down view of a portion of the example printhead 200 including an actuator die 206 on top of a circuit die 204 is shown. Liquid ejection elements 112 are arranged in a generally rectangular row-and-column arrangement on the actuator die 206. Each row has four liquid ejection elements 112, each element 112 having an orifice 290. Although several rows of elements 112 are illustrated, the rows may be replicated from the top to the bottom of the actuator die 206, as indicated by the ellipsis.

Wire bond pads 250C may run along either or both of the side edges of the actuator die 206. For simplicity, one bond pad 250C is illustrated one each side edge in FIG. 3, although typically there will be one bond pad for each ejection element 112 in a row. Drive signal traces (not shown) emanate from the bond pads 250C and extend inward toward the center of the die 206, one trace connecting to each ejection element 112 to provide the drive signal that activates the piezoelectric actuator 224 of the corresponding element 112.

In one example, the spacing 302 between orifices 290 in the long direction of the elements 112 may range from about 0.6 millimeters to about 1.5 millimeters. In one example, the spacing 302 between orifices 290 may be about 1.0 millimeters.

In one example, the spacing 304 between orifices 290 in the short direction of the elements 112 may range from about 1/50th inches to about 1/1200th inches. In one example, the spacing 304 between two orifices 290 in an individual column may be about 1/300th inches.

The example printhead 200 arranges four ejection elements 112 per row. However, the location of the orifices 290 for each of the four ejection elements 112 in a row is staggered along the column axis 310. This allows the effective print resolution of the printhead 200 to be increased. For example, with a spacing 304 of 1/300th inch between the orifices 290 in each of the four columns of ejection elements 112, the orifices 290 in each column may be staggered along the column axis 310 by one-quarter of the spacing 304. Thus while any single column of the elements 112 can deposit drops at a print resolution of 300 dots per inch, by appropriately synchronizing the operation of all four columns, the printhead 200 can deposit drops at a print resolution that is four times greater, 1200 dots per inch.

While the example printhead 200 arranges four ejection elements 112 per row, in other examples there may be fewer or more, such as for example six to eight or more, elements 112 per row. The spacing 304 and the staggering of orifices 290 can be selected to allow different print resolutions to be achieved.

A printhead 200 that spans approximately one inch in height may include 300 rows of liquid ejection elements 112 with a $1/300^{th}$ inch spacing 502, with four elements 112 per row, for a total of 1200 liquid ejection elements. The planar dimensions of the top down view of the entire die stack (including dies 202-208) of such an example printhead 200 may be approximately 1.25 inches high by 0.315 inches wide, and thus have a planar area of approximately 0.34 square inches. In other words, the areal density of the printhead is approximately 3529 nozzles per square inch. A significant amount of heat results from the power dissipation that occurs during printhead operation. As will be discussed subsequently in greater detail, reducing the amount of power dissipation makes the task of cooling the printhead simpler, cheaper, and more convenient.

Figure 4:
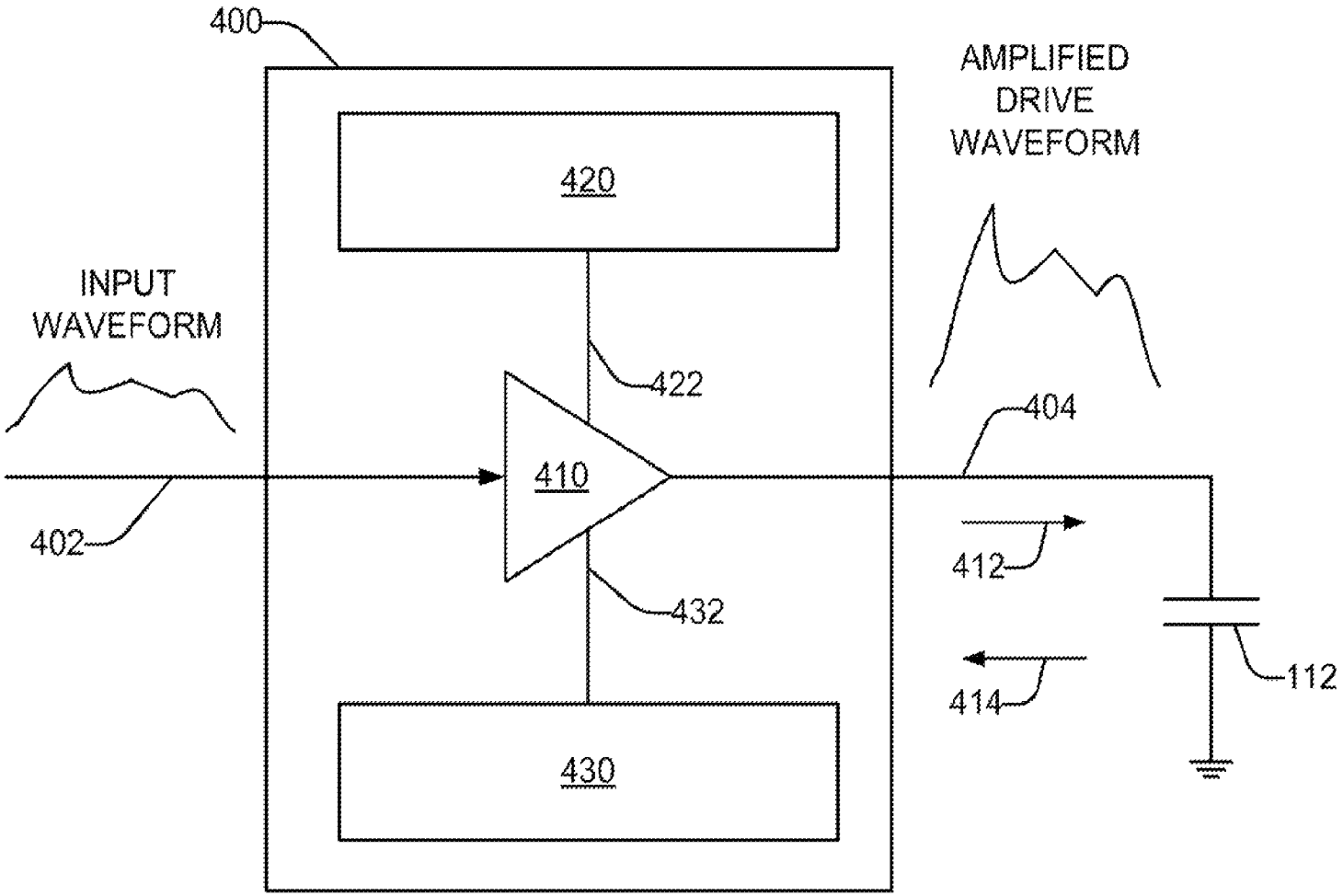
FIG. 4 is a schematic representation of an example drive signal generator in accordance with an embodiment of the present disclosure usable with the printhead of FIG. 2.

Considering now one example of a drive signal generator 114, and with reference to FIG. 4, an example drive signal generator 400 receives an input voltage waveform 402 and generates an amplified voltage drive waveform 404. The input waveform 402 may be an arbitrary waveform. In some examples, the waveform is a low-level pulse, compatible with the voltage requirements of the semiconductor process used to form the ASIC circuitry 234. The pulse may have a predetermined amplitude and duration with a predetermined slew rate on the rising and falling edges, where these characteristics are chosen to compensate for deviations in the ejection characteristics of the particular liquid ejection element 112 to which it is applied, thus trimming the element 112 to properly eject the desired amount of liquid. The amplified waveform 404 is applied as the drive signal to a liquid ejection element, such as element 112, to cause the element 112 to eject liquid. Where two elements 112 have different ejection characteristics, the same intended quantity of liquid can be ejected from both elements 112 by applying a different input waveform 402 to each element, the waveforms 402 having different waveform characteristics that cause the first and second ejection elements to both eject the same intended quantity of liquid.

With regard to the power dissipation resulting from the charging and discharging of the capacitance of the liquid ejection element 112, assume an example capacitance of about 250 picofarads (pF), and a typical peak voltage of the amplified drive waveform 404 of 24 volts (V). As the pulse is applied, such that the voltage at the output of the amplifier 410 is greater than the voltage across the capacitive load of the ejection element 112, current flows in direction 412 into the capacitor. When the capacitor becomes charged to the correct voltage level, the piezoelectric actuator is deformed as part of the process of causing liquid ejection (in some ejection elements 112, the liquid ejection occurs after the capacitor is discharged and the deformation is removed). As the pulse is terminated, the voltage at the output of the amplifier 410 becomes less than the voltage across the capacitive load of the ejection element 112, causing current to flow in the direction 414 out of the capacitor as it is discharged. During charging, an amount of energy is expended by the drive signal generator 400 to charge the capacitor. Then during discharging, an equal amount of energy is returned to the generator 400 from the capacitor. Unless this returned energy can be recaptured, it is dissipated in the generator 400. Assuming the returned energy is dissipated, the energy consumed as a result of the capacitive charging and discharging (ignoring the effect of resistor 406) is:

$$2*(\tfrac{1}{2}CV\hat{}2)=2*(\tfrac{1}{2}*(250\text{ pF})*(24\text{V})\hat{}2)=144\text{ nanojoules (nJ)}$$

In addition, assume that in a typical printing operation the pulse is applied to a liquid ejection element 112 at an 80 kilohertz (kHz) pulse rate (firing rate); 80,000 times per second. Multiplying the activation frequency by the energy dissipation gives the power dissipation in the drive signal generator 400 that results from the charging and discharging of the capacitance during typical operation of a single liquid ejection element:

$$(80\text{ kHz})*(144\text{ nJ})=11.5\text{ milliwatts (mW)}$$

For a printhead 200 having a total of 1200 liquid ejection elements 112, the total power dissipation resulting from the charging and discharging of the capacitance during typical operation of the printhead (not including bias power) is:

$$(1200)*(11.5\text{ mW})=13.8\text{ W}$$

As will be explained subsequently with reference to FIG. 9, accounting for bias power increases the total power dissipation of the printhead 200 to about 15.6 W.

As has been explained heretofore with reference to FIG. 3, the total surface area of the printhead 200 is about 0.34 square inches, yielding a power dissipation density of about 45.9 watts/square inch. This level of power cannot be adequately dissipated using the simpler cooling techniques discussed heretofore. Without adequate power dissipation, the liquid ejection elements 112 will not operate properly due to the conduction of the heat to the pressure chamber 212 and actuators 224 as has been discussed heretofore, but in addition the printhead 200 itself may be damaged or destroyed. As a result, prior to the present disclosure it has not been feasible or practical to provide per-nozzle trim capability on high density piezoelectric printheads 200.

However, the drive signal generator 400 of the present disclosure advantageously reduces the power dissipation of the piezoelectric printhead 200 through energy recapture and regeneration. The generator 400 includes a core amplifier 410. An upper rail power switch 420 is coupled to the Vpp (upper voltage) power input 422 of the core amplifier 410, while a lower rail power switch 430 is coupled to the Vqq (lower voltage) power input 432 of the core amplifier 410. The power rail switches 420, 430, taken together with the core amplifier 410, collectively form a Class-G amplifier which recovers at least a portion of the stored energy from the capacitive load 112 during the decreasing voltage portion of the amplified drive waveform 404 when current flows in the direction 414 out of the capacitor of the liquid ejection element 112.

The core amplifier 410 is a voltage amplifier that amplifies the input waveform 402 and generates the amplified drive waveform 404. In one example, the amplifier 410 is implemented using an op amp with voltage feedback. In one example, the core amplifier 410 has a Class B amplifier output stage with no static bias current. The amplifier 410 has a gain that is sufficient to amplify the input waveform to a voltage range compatible with the drive requirements of the liquid ejection element 112. In one example, where the input waveform 402 has a peak to peak voltage of 1 volt and the amplified drive waveform has a peak voltage of 20 volts, the amplifier has a gain of 20. The accuracy of the amplifier 410 is determined by the linearity error and the gain error. The amplifier 410 has a linearity error less than 2%. Any gain error in the amplifier 410 is calibrated out so as to be substantially absent from the amplified drive waveform 404. In one example, the gain error is calibrated out to within +/−0.5%.

In one example, each amplifier 410 has a bias power dissipation (due to the bias power used to operate the amplifier 410) of about 1.5 milliwatts; a printhead 200 with 1200 liquid ejection elements 112, and thus 1200 corresponding core amplifiers 410, has a total bias power dissipation of about 1.8 watts. (Note that, for the printhead 200, the bias power dissipation of 1.8 watts is in addition to the 13.8 watts of power dissipation due to the capacitance of the liquid ejection element 112.)

The drive signal generator 400 of the present disclosure recaptures and regenerates energy via the rail power switches 420, 430. In operation, each of the rail power switches 420, 430 in effect continuously compares an instantaneous voltage of the amplified drive waveform 404 to the voltages of a subset of the power supplies 126 (FIG. 1) and in response couples to the respective power input 422, 432 the power supply that is both closest to the instantaneous voltage and sufficient to generate the amplified waveform. This results in decreased power dissipation in the drive signal generator 400, as will be explained in greater detail subsequently. More specifically, at least two of the power supplies 126, each having a different fixed voltage, are connected to each of the rail power switches 420, 430. Some of the same voltages may be provided to both of the switches 420, 430. Some of the voltages may be provided to one of the switches 420, 430. In some examples, the voltage from a first power supply may be provided to one of the switches 420, 430 and the voltage from a second power supply may be provided to the other one of the switches 420, 430, while the voltage from at least one power supply is provided to both switches 420, 430.

In one example that will be discussed subsequently with reference to FIGS. 5-7 in greater detail, there are five different power supplies 126 that generate five different voltages, with three of the voltages provided to both switches 420, 430, and the remaining two voltages each provided to one of the switches 420, 430.

Figure 5:
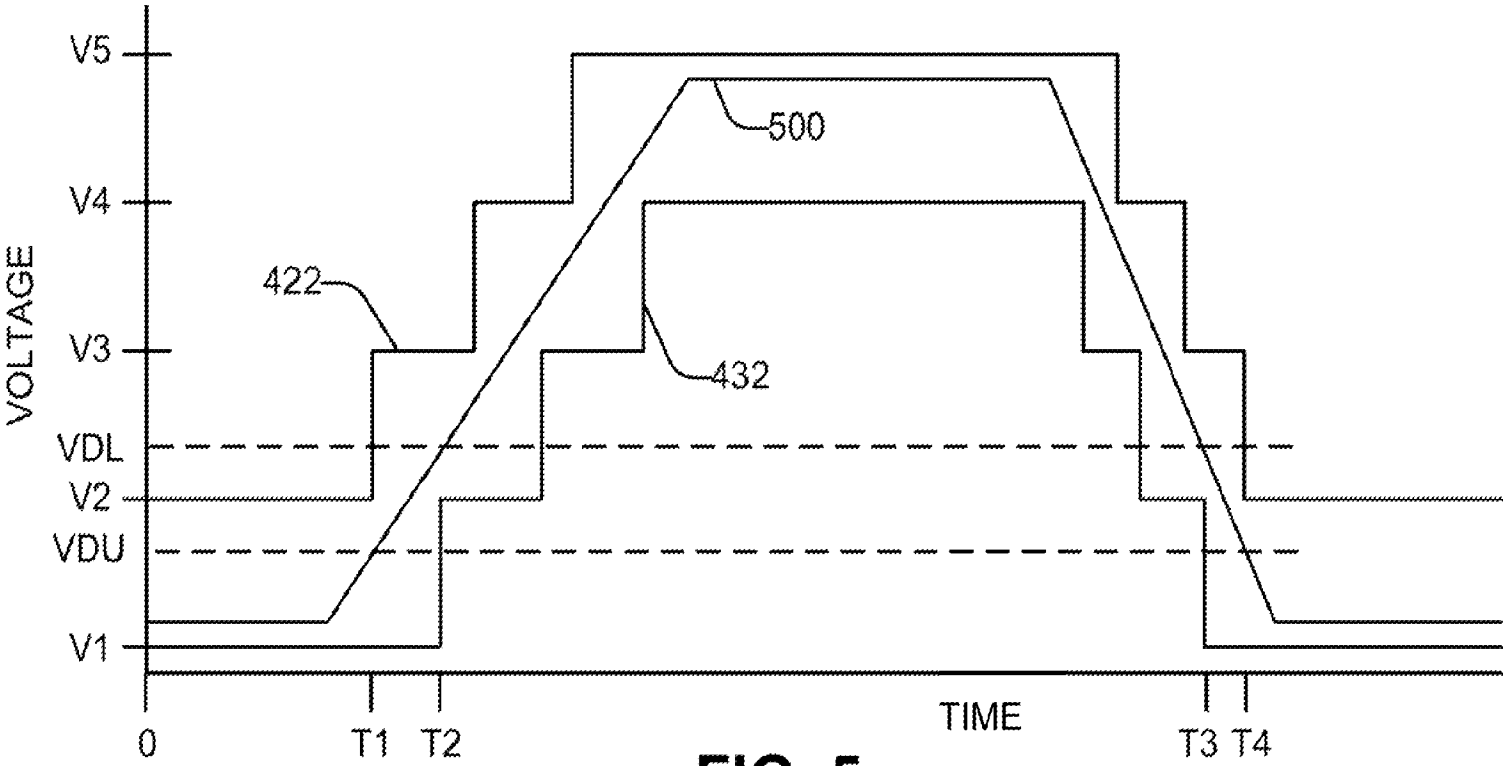
FIG. 5 is a schematic representation of an example amplified drive waveform in accordance with an embodiment of the present disclosure that can be generated by the drive signal generator of FIG. 4.

Considering now the relationship of the amplified drive waveform 404 to the voltages applied to the power inputs 422, 432 of the core amplifier 410, and with reference to FIG. 5, an example amplified drive waveform 500 is considered. The waveform 500 is a pulse that begins at a low voltage level, rises at a first slew rate to a peak voltage level, and after remaining at the peak level for a time falls at a second slew rate back to the low voltage level. This waveform 500 is used for simplicity of explanation, and it is understood that the amplified drive waveform 404 may be any arbitrary voltage waveform.

It can be observed from FIG. 5 that the upper rail voltage 422 is higher than the level of the waveform 500 at all times, and that the lower rail voltage 432 is lower than the level of the waveform 500 at all times. The upper 420 and lower 430 rail power switches provide this operation. It can also be observed that the upper and lower rail voltages are not switched at exactly the same time. This operation insures that there is always a sufficient voltage delta between the upper 422 and lower 432 rail voltages to allow the core amplifier 410 to operate properly.

In operation, this is achieved through predefined dropout voltages. In some examples, the predefined dropout voltages are selected so as to be sufficient for the fastest slew rates, i.e. the worst case with highest current. As noted heretofore, each rail power switch 420, 430 in effect continuously compares an instantaneous voltage of the amplified drive waveform to the voltages of a subset of the power supplies 126. In the example amplified drive waveform 500, five power supplies 126 provide voltages V1 through V5.

To explain the operation, begin at time 0. The waveform 500 has a low voltage level that is between V1 and V2, the upper rail voltage 422 is set to V2, and the lower rail voltage 532 is set to V1. The pulse is initiated, causing the voltage of the waveform 500 to increase. At time T1, when the instantaneous waveform voltage rises to level VDU, the upper rail power switch 420 couples voltage V3 to the Vpp (upper voltage) power input 422 of the core amplifier 410 instead of voltage V2. Put another way, the upper rail power switch 420 selects the voltage source having the voltage which is closest to and higher than the instantaneous voltage of the amplified drive waveform 500 plus an upper dropout voltage. In this example, the voltage difference between V2 and VDU is the dropout voltage for the upper rail.

Now, continue on to time T2. When the instantaneous waveform voltage rises to level VDL, the lower rail power switch 430 couples voltage V2 to the Vqq (lower voltage) power input 432 of the core amplifier 410 instead of voltage V1. Put another way, the lower rail power switch 430 selects the voltage source having the voltage which is closest to and lower than the instantaneous voltage of the amplified drive waveform 500 minus a lower dropout voltage. In this example, the voltage difference between V2 and VDL is the dropout voltage for the lower rail.

By considering the operations at times T1 and T2, it can be appreciated that, on a rising edge of the voltage waveform 500, the voltage applied to the upper power input 422 of the core amplifier 410 is increased before the voltage applied to the lower power input 432 of the core amplifier 410 is increased.

Analogous operations occur as the voltage of the waveform 500 decreases. Just before the voltage approaches time T3, the upper rail voltage 422 is set to V3, and the lower rail voltage 532 is set to V2. At time T3, when the instantaneous waveform voltage falls to level VDL, the lower rail power switch 430 couples voltage V1 to the Vqq (lower voltage) power input 432 of the core amplifier 410 instead of voltage V2. Thus the lower rail power switch 430 selects the voltage source having the voltage which is closest to and lower than the instantaneous voltage of the amplified drive waveform 500 minus the lower dropout voltage.

Now, continue on to time T4. When the instantaneous waveform voltage falls to level VDU, the upper rail power switch 420 couples voltage V2 to the Vpp (upper voltage) power input 432 of the core amplifier 410 instead of voltage V3. Thus the upper rail power switch 420 selects the voltage source having the voltage which is closest to and higher than the instantaneous voltage of the amplified drive waveform 500 plus the upper dropout voltage.

By considering the operations at times T3 and T4, it can be appreciated that, on a falling edge of the voltage waveform 500, the voltage applied to the lower power input 432 of the core amplifier 410 is decreased before the voltage applied to the upper power input 422 of the core amplifier 410 is decreased.

The upper and lower dropout voltages used by the rail power switches 420, 430 may in some examples be the same non-zero voltage, or may be different non-zero voltages. In some examples, the dropout voltages may be less than one volt.

Figure 6:
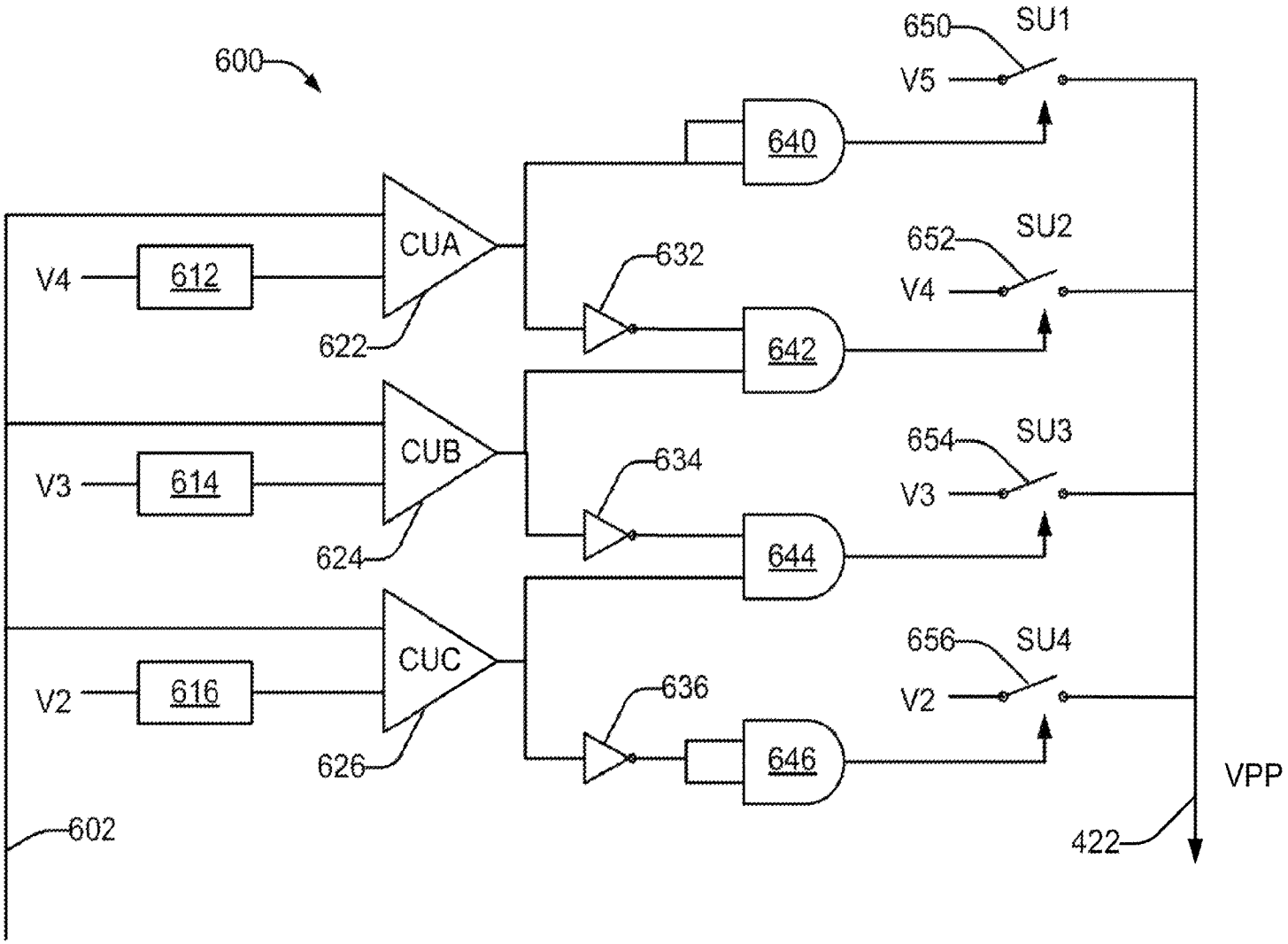
FIG. 6 is a schematic representation of an upper rail power switch in accordance with an embodiment of the present disclosure usable with the drive signal generator of FIG. 4.

Considering now in greater detail the upper rail power switch 420, and with reference to FIG. 6 as well as continued reference to FIG. 5, one example upper rail power switch 600 receives voltages V2 through V5 and a voltage waveform 602, and outputs voltage Vpp to the upper power input 422 of the core amplifier 410.

The voltage waveform 602 has a known relationship to the amplified drive waveform 404 that is applied to the liquid ejection element 112 such that the upper rail power switch 600 can, in effect, compare the instantaneous voltage of the amplified waveform 404 to at least some of the voltages V2 through V5 from power supplies 126. However, since the amplified waveform 404 typically is a high voltage waveform, the amplified waveform 404 itself is not typically used as the voltage waveform 602. Instead, the voltage waveform 602 typically is a low-level signal that is compatible with the voltage requirements of the logic elements of the rail power switch. For example, in the printhead 200 (FIG. 2), the voltage waveform 602 has voltage levels which are compatible with the voltage requirements of the semiconductor process used to form the ASIC circuitry 234.

In some examples, the voltage waveform 602 may be the input waveform 402. The gain of the amplifier 410 that amplifies the input waveform 402 to form the amplified drive waveform 404 is known. Voltage divider (scaler) circuits 612, 614, 616 that effectively divide or scale down the voltages V2 through V4 by the same amplifier gain allow comparators 622, 624, 626 to use the input waveform 402 to effectively compare the instantaneous voltage of the amplified waveform 404 to the power supply voltages. In some examples, the voltage divider (scaler) circuits 612, 614, 616 add an appropriate offset for the dropout voltage, such that the output of the voltage divider circuit=(input voltage–dropout voltage)/gain. For example, for voltage divider circuit 612, assume that input voltage V4=24V, the dropout voltage=4V, and the gain is 20. In this case, the output of voltage divider circuit 612=1V.

The combination of scaler 612 and comparator CUA 622 effectively compares the amplified drive waveform 404 to voltage V4. The combination of scaler 614 and comparator CUB 624 effectively compares the amplified drive waveform 404 to voltage V3. The combination of scaler 616 and comparator CUC 626 effectively compares the amplified drive waveform 404 to voltage V2. On comparators 622, 624, 626, the bottom input is the reference, and the top input is the signal to be compared; if the signal exceeds the reference, the comparator outputs a logic 1; otherwise, the comparator outputs a logic 0. In some examples, additional circuitry (not shown) may be included to prevent inadvertent shoot-through, i.e. the case in which multiple switches on the same power rail, such as for example switches 654, 656) are turned on at the same time due to timing delays or a mismatch between devices. This additional circuitry can prevent the power supplies from shorting together and rendering the entire system non-functional or in a state of high power dissipation.

The logic arrangement implemented by invertors 632, 634, 636 and AND gates 640, 642, 644, 646 uses the outputs of comparators 622, 624, 626 to select which one of the power supply voltages to connect to the Vpp input 422. The switches 650, 652, 654, 656 or ancillary circuitry (not shown) operate to connect one of the supply voltages V2-V5 to the Vpp input 422 at any point in time.

Switches SU1 650, SU2 652, SU3 654, and SU4 656, while illustrated as electromechanical switches for simplicity, are typically electronic high voltage switches. When the output of the AND gate that is connected to the switch control input is a logic 1 level, the switch closes to connect the corresponding one of the supply voltages V2-V5 to the Vpp input 422.

The operation of the upper rail power switch 600 can be appreciated with reference to the table 800 of FIG. 8. Consider, for example, the case when the amplified waveform 404 voltage is between V3 and V4. Comparator CUA 622 outputs a logic 0, while comparators CUB 624 and CUC 626 output a logic 1. The logic arrangement of the inverters and AND gates output a logic 1 to switch SU2 652, and a logic 0 to the other switches. High voltage switch SU2 652 closes to apply V4 as the Vpp voltage to the upper power input 422 of the core amplifier 410.

Figure 7:
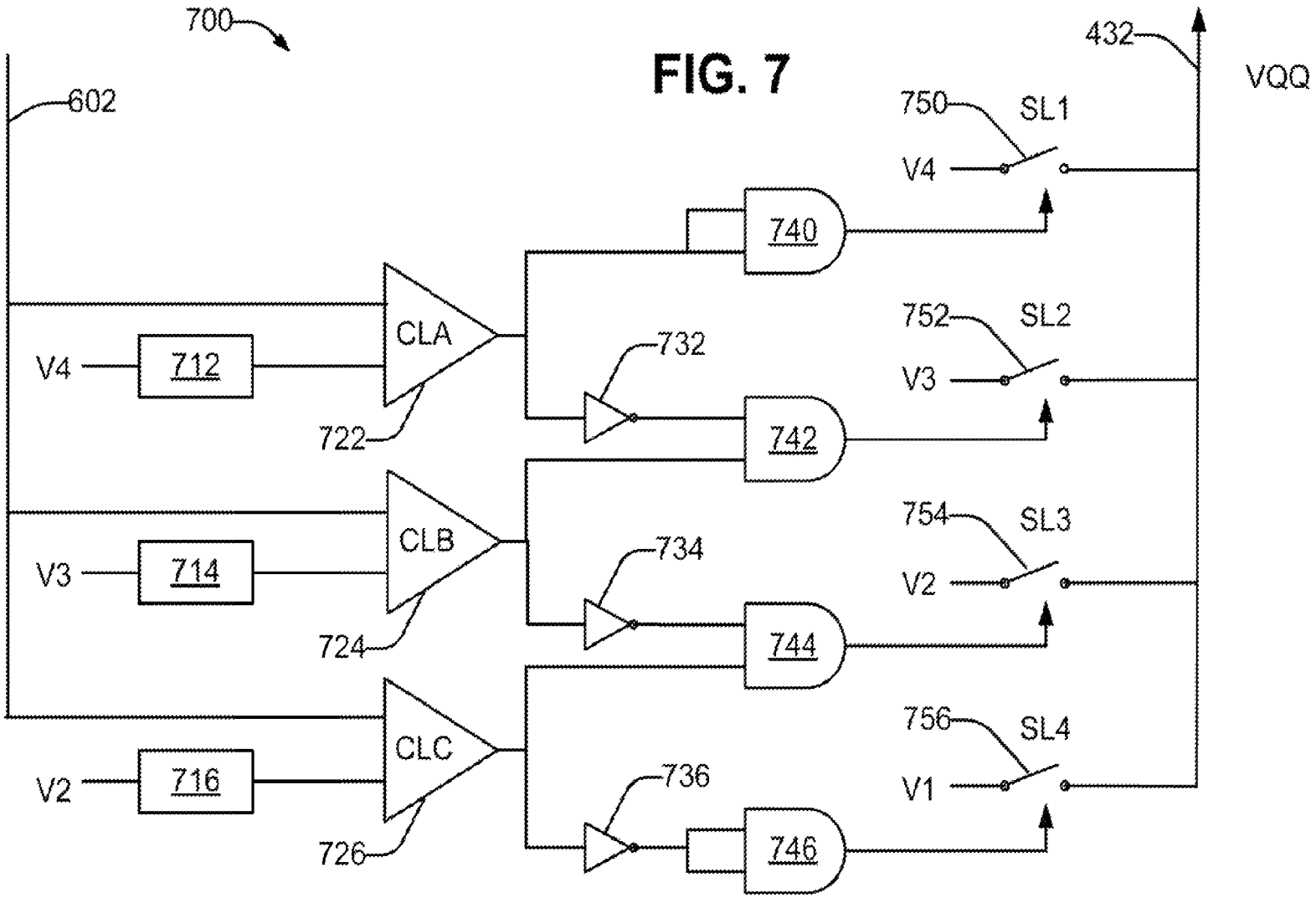
FIG. 7 is a schematic representation of a lower rail power switch in accordance with an embodiment of the present disclosure usable with the drive signal generator of FIG. 4.

Considering now in greater detail the upper rail power switch 430, and with reference to FIG. 7 as well as continued reference to FIG. 5, one example lower rail power switch 700 receives voltages V1 through V4 and the voltage waveform 602, and outputs voltage Vqq to the lower power input 432 of the core amplifier 410.

Voltage divider (scaler) circuits 712, 714, 716 effectively divide or scale down the voltages V2 through V4 by the amplifier gain to allow comparators 722, 724, 726 to use the input waveform 402 to effectively compare the instantaneous voltage of the amplified waveform 404 to the power supply voltages. In some examples, the voltage divider (scaler) circuits 712, 714, 716 add an appropriate offset for the dropout voltage, such that the output of the voltage divider circuit=(input voltage+dropout voltage)/gain. For example, for voltage divider circuit 712, assume that input voltage V4=24V, the dropout voltage=4V, and the gain is 20. In this case, the output of voltage divider circuit 612=1.4V.

The combination of scaler 712 and comparator CLA 722 effectively compares the amplified drive waveform 404 to voltage V4. The combination of scaler 714 and comparator CLB 724 effectively compares the amplified drive waveform 404 to voltage V3. The combination of scaler 716 and comparator CLC 726 effectively compares the amplified drive waveform 404 to voltage V2. On comparators 722, 724, 726, the bottom input is the reference, and the top input is the signal to be compared; if the signal exceeds the reference, the comparator outputs a logic 1; otherwise, the comparator outputs a logic 0.

The logic arrangement implemented by invertors 732, 734, 736 and AND gates 740, 742, 744, 746 uses the outputs of comparators 722, 724, 726 to select which one of the power supply voltages to connect to the Vqq input 432. The switches 750, 752, 754, 756 or ancillary circuitry (not shown) operate to connect one of the supply voltages V1-V5 to the Vqq input 432 at any point in time.

Switches SL1 750, SL2 752, SL3 754, and SL4 756, while illustrated as electromechanical switches for simplicity, are typically electronic high voltage switches. When the output of the AND gate that is connected to the switch control input is a logic 1 level, the switch closes to connect the corresponding one of the supply voltages V1-V4 to the Vqq input 432.

The operation of the lower rail power switch 700 can be appreciated with reference to the table 800 of FIG. 8. Consider, for example, the case when the amplified waveform 404 voltage is between V4 and V5. All three comparators CLA 722, CLB 724, and CLC 726 output a logic 1. The logic arrangement of the inverters and AND gates output a logic 1 to switch SL1 750, and a logic 0 to the other switches. High voltage switch SL1 750 closes to apply V4 as the Vqq voltage to the lower power input 432 of the core amplifier 410.

Figure 9:
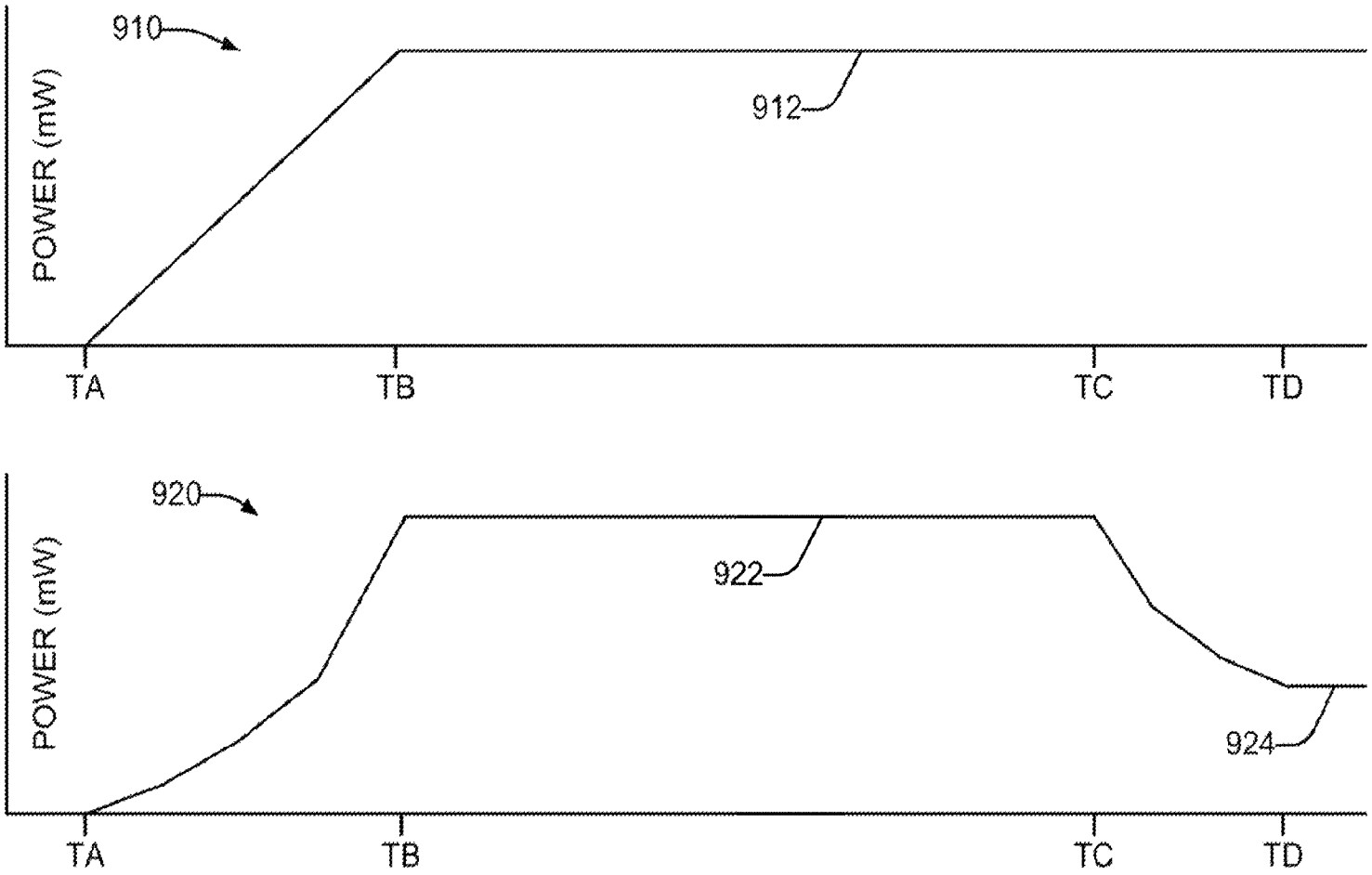
FIG. 9 is a schematic representation of example power dissipation waveforms that illustrate the recovery and regeneration of energy by the drive signal generator of FIG. 4 in accordance with an embodiment of the present disclosure.

Considering now in greater detail the recovery and regeneration of energy by the drive signal generator 400 and the corresponding decreased power dissipation on the printhead 200, and with reference to FIG. 9, the rail power switches 420, 430 reduce the net integrated power that is consumed by the drive signal generator 400. Net integrated power is defined as the integral of power input to the capacitive load of the liquid ejection element 112 minus power recovered from the capacitive load.

FIG. 9 illustrates two graphs of net integrated power. In both graphs 910, 920, a drive waveform having the same general shape as amplified drive waveform 500 (FIG. 5) is generated. Graph 910 depicts the net integrated power supplied to a drive signal generator that does not have rail power switches. Net integrated power is not just load power, but rather is the power provided from the power supply to the drive signal generator 400. In other words, voltage V5 is applied to the Vpp upper power input 422 of core amplifier 410, and voltage V1 is applied to the Vqq lower power input 432. Graph 920 depicts the net integrated power for the drive signal generator 400 that includes rail power switches 600, 700. In other words, the voltage applied to the Vpp upper power input 422 of core amplifier 410, and the voltage applied to the Vqq lower power input 432, are determined based on voltage waveform 602 in accordance with table 800 of FIG. 8 and as indicated in FIG. 5.

For purposes of graphs 910, 920, it is assumed that the core amplifier 410 and the rail power switches 600, 700 are ideal, and consume no bias power.

The rising edge of the waveform 500 pulse begins at time TA. At time TB, the voltage of waveform pulse 500 reaches its highest level, and remains at that level until time TC. The falling edge of the waveform 500 pulse begins at time TC. At time TD, the waveform pulse 500 returns to its initial voltage level.

In graph 910, it is observed that the net integrated power begins at zero and rises linearly from time TA to time TB. At time TB the capacitive load of the liquid ejection element 112 has been fully charged, and liquid ejection occurs; no further power is input to the load during this time, as the voltage remains constant. At time TC through time TD, the capacitive load is discharged as the pulse is removed. No additional power is applied to the load; rather, all of the energy stored in the load is dissipated in the drive signal generator; none of it is recovered for subsequent use.

In graph 920, by comparison, it is observed that the net integrated power begins at zero and rises substantially quadratically from time TA to time TB. The substantially quadratic rise occurs in a series of substantially piecewise-linear sections. This occurs because the slope of each of the linear sections changes at I*V, where I is constant into the load due to the constant slew rate, and V is different for each section of the piecewise linear graph over the integration time due to the switching of the voltage levels. At time TB the capacitive load of the liquid ejection element 112 has been fully charged, and liquid ejection occurs; no further power is input to the load during this time, as the voltage remains constant. At time TC through time TD, the capacitive load is discharged as the pulse is removed. However, a significant amount, but not all, of the energy stored in the load is recovered for subsequent use, as can be seen by the piecewise linear reduction in net integrated power from time TC through time TD. Thus at time TD, the net integrated power has been reduced significantly from the peak value that existing between times TB and TC.

The power is recovered from the load and used to charge the storage capacitors in the closest voltage level that can be switched-in below the load voltage. In this way, the power supply at that voltage level will have its use of average current from an outside source reduced. For example, if the load voltage is at V5, and the load voltage is being slewed downward, then the power supply for voltage V4 will have current entering it from the printhead. For all supplies, there will be a net output of power, and output of current, to the printhead. However, for supplies V4-V1, there will be bi-directional current flow. The portion of the current flow that returns to the system from the printhead provides the recovered energy benefit.

For the drive signal generator that does not include rail power switches, the net integrated power 912 at time TD and beyond is about 11.5 milliwatts, as has been discussed previously with respect to FIG. 4.

However, for the drive signal generator 400 that includes rail power switches 600, 700, the peak net integrated power 922 between times TB to TC is about 7.3 milliwatts. When driving the capacitive load, approximately half of the power dissipation occurs when charging the load. The remainder occurs when discharging. This explains why the peak of 922 is approximately one-half the peak of 912. In addition, as a result of the recapture that occurs between times TC and TD, the net integrated power 924 at time TD, after the pulse has concluded, is about 2.9 milliwatts. This is a reduction in net integrated power of over 70%.

To determine the reduction in power dissipation that is achievable for a particular printhead with a waveform-per-nozzle architecture that enables per-nozzle trimming, the bias power of a typical, rather than ideal, core amplifier 410 and the rail power switches 600, 700 are included in the analysis.

For the drive signal generator that does not include rail power switches, and bias power for the core amplifier 410 of 1.5 milliwatts, the total net integrated power=11.5 milliwatts (for charging and discharging the load)+1.5 milliwatts (bias)=13.0 milliwatts per ejection element 112. For a printhead with 1200 nozzles, the total net integrated power dissipation is about 15.6 watts.

For the drive signal generator 400 that includes rail power switches 600, 700, assume that in addition to the core amplifier 410 bias power of 1.5 milliwatts, each rail power switch has bias power of about 0.5 milliwatts. This is primarily a result of the use of the eight high voltage switches 650-656, 750-756. Thus the total bias power of the generator 400 is about 5.5 milliwatts. The total net integrated power=2.9 milliwatts (for charging and discharging the load)+5.5 milliwatts (bias)=8.4 milliwatts per ejection element 112. For a printhead with 1200 nozzles, the total net integrated power dissipation is about 10.1 watts. Thus use of the rail power switches 600, 700 in a Class-G architecture can achieve about a 35% reduction in printhead power dissipation. This represents a significant reduction in power dissipation (and heat), enabling the printhead(s), and thus the printing system, to be cooled using the simpler cooling techniques listed heretofore. Reduction in the bias power used by the drive signal generator 400 such as, for example, by the high voltage switches, could further improve power dissipation reduction to about 60%.

The reduction in power consumption and dissipation provided by the techniques of the present disclosure may also allow a printhead to operate in new or additional printing modes. For example, because energy is dissipated each time the capacitive load is charged and discharged to emit a drop, it may not have been possible to adequately cool the printhead if operated in a mode that ejects multiple drops from individual liquid ejection elements in a single ejection event. However, applying the techniques of the present disclosure that reduce power consumption and dissipation can allow the printhead to be adequately cooled when operated in this mode.

Figure 10:
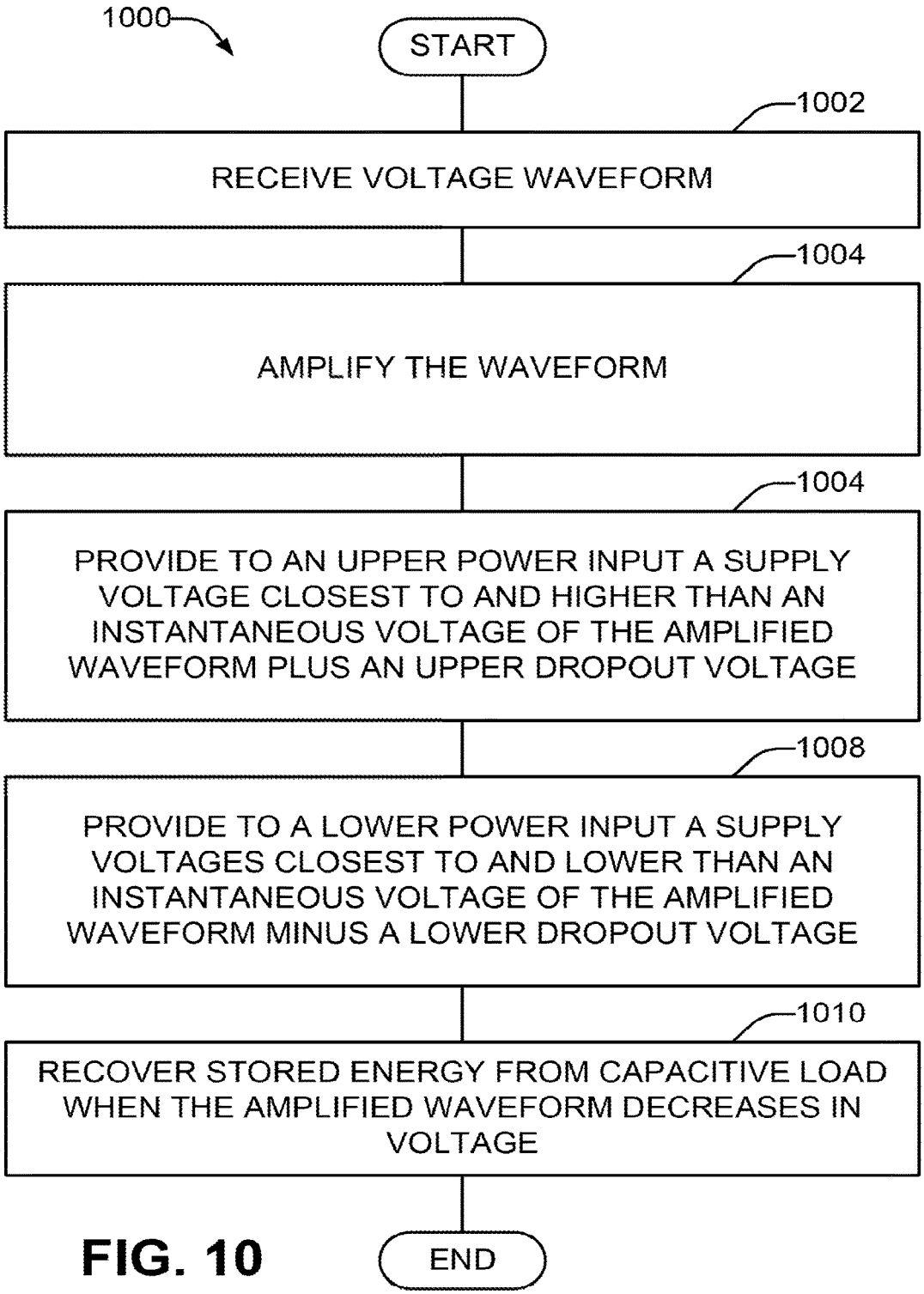
FIG. 10 is a flowchart in accordance with an embodiment of the present disclosure of a method of operating a drive signal generator on a piezoelectric printhead to drive a liquid ejection element on the printhead.

Considering now one example method of operating a drive signal generator to drive a liquid ejection element of a piezoelectric printhead, and with reference to FIG. 10, a method 1000 begins at 1002 by receiving a voltage waveform to drive an amplifier core. At 1004, the waveform is amplified to provide an amplified voltage waveform to the liquid ejection element. The liquid ejection element may present to the amplifier a substantially capacitive load that stores energy. At 1006, a selected one of a set of supply voltages is provided to an upper power input of the amplifier core, the selected supply voltage being closest to and higher than an instantaneous voltage of the amplified waveform plus an upper dropout voltage. At 1008, a selected one of a set of supply voltages is provided to a lower power input of the amplifier core, the selected supply voltage being closest to and lower than an instantaneous voltage of the amplified waveform minus a lower dropout voltage. At 1010, at least a portion of the stored energy from the capacitive load is recovered in the drive signal generator when the amplified waveform decreases in voltage.

From the foregoing it will be appreciated that the printhead, drive signal generator, and methods provided by the present disclosure represent a significant advance in the art. Although several specific examples have been described and illustrated, the disclosure is not limited to the specific methods, forms, or arrangements of parts so described and illustrated. For instance, examples of the disclosure are not limited to ejecting liquids which are inks. Other examples of liquids may include drugs, cellular products, organisms, fuel, and so on, which are not substantially or primarily composed of gases such as air and other types of gases. In addition, while examples of liquid ejection element having piezoelectric actuators have been described, the apparatuses and methods provided by the present disclosure may also be used with liquid ejection elements having moveable plate capacitor actuators. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Terms of orientation and relative position (such as "top," "bottom," "side," and the like) are not intended to require a particular orientation of any element or assembly, and are used only for convenience of illustration and description. Unless otherwise specified, steps of a method claim need not be performed in the order specified. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A piezoelectric printing apparatus, comprising:

a plurality of independently-controllable fluid ejection elements; and a corresponding plurality of Class-G voltage amplifiers, each Class-G voltage amplifier to receive an input waveform for a respective fluid ejection element of the fluid ejection elements, and provide to the respective fluid ejection element in response an amplified waveform drive signal that causes the respective fluid ejection element to eject a quantity of fluid, wherein each Class-G voltage amplifier of the plurality of Class-G voltage amplifiers comprises:

a core amplifier to receive the input waveform and generate an amplified drive signal;

an upper rail power switch to compare an instantaneous voltage of the amplified drive signal to at least some of a plurality of upper voltage sources, and couple to an upper power input of the core amplifier the upper voltage source that is closest to and higher than the instantaneous voltage; and a lower rail power switch to compare the instantaneous voltage of the amplified drive signal to at least some of a plurality of lower voltage sources, and couple to a lower power input of the core amplifier the lower voltage source that is closest to and lower than the instantaneous voltage.

2. The piezoelectric printing apparatus of claim 1, wherein each fluid ejection element of the fluid ejection elements is a piezoelectric inkjet ejection element that presents a capacitive load to the corresponding Class-G voltage amplifier.

3. The piezoelectric printing apparatus of claim 2, wherein the capacitive load stores energy from the corresponding Class-G amplifier during an increasing voltage portion of the amplified drive signal generated by the corresponding Class-G amplifier.

4. The piezoelectric printing apparatus of claim 1, further comprising a printhead, wherein the fluid ejection elements and the Class-G voltage amplifiers are disposed in the printhead.

5. The piezoelectric printing apparatus of claim 4, wherein the fluid ejection elements and the Class-G voltage amplifiers are disposed on a same substrate in the printhead.

6. The piezoelectric printing apparatus of claim 1, wherein a first of the fluid ejection elements has a different ejection characteristic from a second of the fluid ejection elements, and wherein a first input waveform to a first Class-G voltage amplifier has a waveform characteristic different from a waveform characteristic of a second input waveform to a second Class-G voltage amplifier, and wherein respective first and second fluid ejection elements driven by the first and second Class-G voltage amplifiers, respectively, are to eject a same quantity of fluid.

7. The piezoelectric printing apparatus of claim 1, wherein the upper rail power switch is to couple to the upper power input of the core amplifier the upper voltage source that is closest to and higher than the instantaneous voltage plus an upper dropout voltage; and wherein the lower rail power switch is to couple to the lower power input of the core amplifier the lower voltage source that is closest to and lower than the instantaneous voltage minus a lower dropout voltage.

8. The piezoelectric printing apparatus of claim 1, wherein the core amplifier has a gain, wherein the upper rail power switch comprises:

a voltage scaler to divide a voltage from each of the subset of upper voltage sources by the gain to produce corresponding scaled voltages, and a comparator to compare the instantaneous voltage of the amplified drive signal to the scaled voltages.

9. A method of driving a fluid ejection element of a piezoelectric printhead, comprising:

amplifying, by a core amplifier, a voltage waveform to provide an amplified voltage waveform to the fluid ejection element;

comparing, by a first comparator, an instantaneous voltage of the amplified voltage waveform to a first set of supply voltages;

based on the comparing by the first comparator, selecting, from among the first set of supply voltages, a first supply voltage that is closest to and higher than the instantaneous voltage of the amplified voltage waveform;

comparing, by a second comparator, the instantaneous voltage of the amplified voltage waveform to a second set of supply voltages;

based on the comparing by the second comparator, selecting, from among the second set of supply voltages, a second supply voltage that is closest to and lower than the instantaneous voltage of the amplified voltage waveform;

providing to an upper power input of the core amplifier the selected first supply voltage; and providing to a lower power input of the core amplifier the selected second supply voltage.

10. The method of claim 9, wherein the selected first supply voltage is closest to and higher than the instantaneous voltage of the amplified voltage waveform plus an upper dropout voltage, and wherein the selected second supply voltage is closest to and lower than the instantaneous voltage of the amplified voltage waveform minus a lower dropout voltage.

11. The method of claim 9, wherein, on a rising edge of the amplified voltage waveform, the selected first supply voltage applied to the upper power input is increased before the selected second supply voltage applied to the lower power input is increased, and wherein, on a falling edge of the amplified voltage waveform, the selected second supply voltage applied to the lower power input is decreased before the selected first supply voltage applied to the upper power input is decreased.

12. The method of claim 9, wherein the fluid ejection element is a capacitive load that stores energy, the method further comprising:

recovering at least a portion of the stored energy from the capacitive load when the amplified voltage waveform decreases in voltage.

13. A drive signal generator for a fluid ejection element of a piezoelectric printhead, comprising:

a core amplifier to amplify an input waveform to provide an amplified waveform;

a plurality of rail power circuits, each coupled to a different power input of the core amplifier, each rail power circuit of the plurality of rail power circuits comprising:

a comparator to compare an instantaneous voltage of the amplified waveform to a subset of a plurality of voltage sources, and a switch to, based on the comparing by the comparator, couple to a respective power input of the core amplifier a voltage source in the subset of the plurality of voltage sources that is closest to the instantaneous voltage and sufficient to generate the amplified waveform.

14. The drive signal generator of claim 13, wherein the core amplifier has a gain, wherein each rail power circuit of the plurality of rail power circuits includes a voltage scaler to divide each of the subset of the plurality of voltage sources by the gain to form corresponding scaled voltage sources, and wherein the comparator is to compare the instantaneous voltage of the amplified waveform to the subset of the plurality of voltage sources by comparing the instantaneous voltage of the input waveform to the scaled voltage sources.

15. The drive signal generator of claim 13, wherein the core amplifier comprises an upper and a lower power input, wherein the plurality of rail power circuits comprises corresponding upper and lower rail circuits, wherein the plurality of voltage sources includes a plurality of upper and of lower voltage sources, wherein the switch of the upper rail circuit is to couple to the upper power input the upper voltage source that has a voltage closest to and higher than the instantaneous voltage of the amplified waveform plus an upper dropout voltage, and wherein the switch of the lower rail circuit is to couple to the lower power input the lower voltage source that has a voltage closest to and lower than the instantaneous voltage of the amplified waveform minus a lower dropout voltage.

16. The drive signal generator of claim 15, wherein each upper voltage source has a different upper voltage, and each lower voltage source has a different lower voltage, and wherein all but one of the upper voltage sources have the same voltage as a corresponding one of the lower voltage sources.

17. The drive signal generator of claim 13, wherein the subset of the plurality of voltage sources comprises N voltage sources;

wherein the switch of a respective rail power circuit of the plurality of rail power circuits comprises N high voltage switches each to connect one of the N voltage sources to the power input of the core amplifier associated with the respective rail power circuit;

wherein the comparator of the respective rail power circuit comprises N−1 low voltage comparators each having a first input connected to the input waveform, and a second input connected to N−1 of the voltage sources through a voltage scaler that divides a voltage of the voltage source by a gain of the core amplifier; and wherein each rail power circuit comprises logic coupled to an output of each of the N−1 low voltage comparators and to control the N high voltage switches so as to connect a single one of the N voltage sources to the power input for any voltage of the input waveform.

18. The drive signal generator of claim 13, wherein the drive signal generator is part of a Class-G amplifier.

* * * * *